US005657811A

United States Patent [19]

Cook

[11] Patent Number: 5,657,811

[45] Date of Patent: *Aug. 19, 1997

[54] CAST-IN HERMETIC ELECTRICAL FEED-THROUGHS

[75] Inventor: Arnold J. Cook, Mt. Pleasant, Pa.

[73] Assignee: PCC Composites, Inc., Pittsburgh, Pa.

[ * ] Notice: The term of this patent shall not extend beyond the expiration date of Pat. No. 5,311,920.

[21] Appl. No.: 456,569

[22] Filed: Jun. 1, 1995

Related U.S. Application Data

[63] Continuation of Ser. No. 72,477, Jun. 4, 1993, abandoned.

[51] Int. Cl.[6] ..... B22D 19/14

[52] U.S. Cl. ..... 164/97; 164/98

[58] Field of Search ..... 164/97, 98, 61; 264/271.1, 279.1, 61; 228/180.1

[56] References Cited

U.S. PATENT DOCUMENTS

| | | | |
|---|---|---|---|
| B 509,772 | 3/1976 | Chirino | 264/61 |
| 2,890,318 | 6/1959 | Kruse | 164/98 |
| 3,350,759 | 11/1967 | Antunes | 164/98 |
| 3,384,931 | 5/1968 | Cochran | 164/98 |
| 3,617,817 | 11/1971 | Kawakatsu | 264/61 |
| 3,863,701 | 2/1975 | Niimi | 164/98 |
| 4,473,615 | 9/1984 | Rademacher et al. | 264/240 |
| 4,688,152 | 8/1987 | Chia | 264/271.1 |
| 4,867,839 | 9/1989 | Sato et al. | 264/271.1 |
| 4,991,283 | 2/1991 | Johnson | 264/61 |
| 5,163,499 | 11/1992 | Newkirk | 164/98 |
| 5,290,197 | 3/1994 | Ohnuma | 264/272.17 |

FOREIGN PATENT DOCUMENTS

| | | | |
|---|---|---|---|
| 4214522 | 12/1992 | Germany | 164/98 |
| 58-93552 | 6/1983 | Japan | 164/98 |
| 59-64150 | 4/1984 | Japan | 164/98 |
| 62-252657 | 11/1987 | Japan | 164/98 |
| 1273664 | 11/1989 | Japan | 164/98 |

*Primary Examiner*—Kuang Y. Lin

*Attorney, Agent, or Firm*—Eckert Seamans Cherin & Mellott, LLC

[57] ABSTRACT

The present invention describes a component with an in-situ formed insulator and a method of forming a component of the same. The method includes the step of orienting an insulator in a mold. Then, there is the step of introducing molten material, such as metal into the mold about the insulator to form a component having a cast-in electrical feed-through. Preferably, the feed-through is hermetically sealed within the component. In one embodiment, the insulator has at least one hole and the introducing step includes the step of filling the mold with molten metal to bond the metal to the insulator and to fill the hole with metal. Preferably, after the introducing step, there is the step of removing any skin of metal between metal within the hole and metal outside of the insulator. After the removing step, there can be the steps of drilling a hole into the metal within the insulator and inserting a conductor into the hole. The conductor can be brazed or cemented to the metal within the insulator. In another embodiment, before the introducing step, there is the step of disposing a conductor within a hole of the insulator. Preferably, after the introducing step, there is the step of removing any skin of metal between the conductor and the metal of the component. If desired, before the introducing step, there can be the step of placing reinforcement, such as a preform, within the mold and the introducing step includes the step of forcing molten metal into the mold to infiltrate the reinforcement.

41 Claims, 8 Drawing Sheets

CAST-IN HERMETIC ELECTRICAL FEED-THROUGHS

This is a continuation of application Ser. No. 08/072,477 filed on Jun. 4, 1993 now abandoned.

CROSS-REFERENCE

U.S. patent application Ser. Nos. 07/795,105 and 08/012,058

FIELD OF THE INVENTION

The present invention relates in general to casting. More specifically, the present invention is related to the casting of components having cast-in feed-throughs.

BACKGROUND OF THE INVENTION

There are many applications which require electrical or thermal passageways through components. For instance, some electronic components require electrically isolated paths through the walls or base of a housing or substrate. These passageways are normally formed by casting a hole in a component and then connecting a feed-through, comprised of an electrical conductor inside an insulator, inside the hole. Typically, the insulator is either cemented, soldered or fused into the hole. For instance, with respect to fusing, a glass frit insert with a hole through the center can be placed into a hole in an electrical package. A pin is then placed in the hole of the glass frit. The whole system is then heated so that the glass melts and fuses to the metal of the package and the pin to form a hermetic electrically isolated electrical feed-through.

Another known method to produce feed-throughs is to produce glass-to-metal seals whereby a conductor pin is bonded to glass, such as borosilicate in a metal ring such as kovar. The metal ring with feed-throughs is then brazed or cemented into another part for providing electrical feed-throughs. Much development has occurred in this area and these types of feed-throughs are available from companies such as Balo Precision Parts, Inc. and Olin Aegis, Inc.

Another known method of producing electrical feed-throughs involves co-fired ceramics. In this method, a ceramic substrate is tape cast and an electrical conductive material is silk screened onto the ceramic, then another piece of ceramic is laid on top of the screened conductive material. The system is then fired to bond the ceramic pieces together with the conductive trace running through it. This type of feed-through is made by a number of companies including Coors Ceramics, Inc. and Sumatoma, Inc. To install this type of feed-through on a component, such as an electronic package, it can either be cemented in place or the outside of the feed-through can be selectively plated and then soldered into a metal package. This type of feed-through is normally made of approximately 95% to 98% dense alumina. However, the nature of this type of feed-through makes it difficult to produce so that it is hermetic. The resultant ceramic is not completely hermetic because it will allow a small amount of gas to flow through it.

Feed-throughs may also be made by use of a plastic, epoxy or other thermal set or thermal cure material in place of glass or ceramic. However, these type of feed-throughs have problems with higher temperatures because of melting and cracking which may occur, and they also absorb water and cause electronic problems.

The present invention describes a method, ideal but not limited, for making electrical feed-throughs which are hermetic and are not sensitive to heat. The present invention produces feed-throughs at low cost with a high number of vias that are hermetic. The present invention allows for the production of electronic components with in-situ feed-throughs with only minimal secondary operations. The present invention also allows for high quantities of closely spaced hermetic vias.

SUMMARY OF THE INVENTION

The present invention is a method of forming a component. The method includes the step of orienting an insulator in a mold. Then, there is the step of introducing molten material, such as metal, into the mold about the insulator to form a component having a cast-in electrical feed-through. Preferably, the feed-through is hermetically sealed within the component.

In one embodiment, the insulator has at least one hole and the introducing step includes the step of filling the mold with molten metal to bond the metal to the insulator and to fill the hole with metal. Preferably, after the introducing step, there is the step of removing any skin of metal between metal within the hole and metal outside of the insulator. Preferably, after the removing step, there are the steps of drilling a hole into the metal within the insulator and inserting a conductor into the hole. The conductor can be brazed or cemented to the metal within the insulator. In another embodiment, before the introducing step, there is the step of disposing a conductor within a hole of the insulator.

If desired, before the introducing step, there can be the step of placing reinforcement, such as a preform, within the mold and the introducing step includes the step of forcing molten metal into the mold to infiltrate the reinforcement. Preferably, before the step of placing reinforcement in the mold, there is the step of forming holes in the reinforcement for holding the insulator and the orienting step includes the step of disposing the insulator in the holes of the reinforcement.

Insulators may also be cast into the preform prior to loading in the casting mold. In one embodiment, insulators are loaded into a preform injection mold and then a reinforcement suspended in a flow agent are injected into the mold. The resulting part is then debinded to create a preform with insulators which can then be loaded into the casting mold. In another embodiment, single die casting, as described in U.S. Pat. No. 5,183,096, can be used to locate reinforcement around insulators placed in a casting mold.

In this invention, almost any material may be cast into the mold. Polymers and plastics can be used. Aluminum, copper, silver, gold, magnesium, and other metals work well with oxides based on similar systems. For example, aluminum bonds well with aluminum oxide insulators or aluminum nitride insulators. Many configurations are possible to produce different types of feed-throughs. For instance, the present invention can produce feed-throughs onto a material for surface mounting of an electronic component. It is also possible to create raised pin feed-throughs that may be soldered to or used to plug into spring loaded slip electrical contacts.

Preferably, the introducing step includes the step of pressurizing liquid metal into the mold to bond the insulator to the metal. In one embodiment, before the pressurizing step, there is the step of placing the mold within a pressure vessel and the pressurizing liquid metal step includes the step of pressurizing the pressure vessel such that molten metal is forced into the mold about the insulator. In another embodiment, the pressurizing step includes the step of injection molding the metal.

In another embodiment, the pressurizing step includes the step of forcing the metal into the mold with a squeeze casting machine. In yet another embodiment, the pressurizing step includes the step of forcing the metal into the mold with a hot isostatic press.

The present invention also describes methods wherein a substrate or conductor are situated in a mold prior to the introduction of a material to form a component with an integrally formed, bonded, substrate or conductor.

The present invention is also a component comprising a material and an in-situ electrical feed-through disposed in and integrally formed with the material. Preferably, the electrical feed-through comprises at least one conductive path disposed through an insulator.

Preferably, the component comprises reinforcement material infiltrated by metal. If desired, the reinforcement and metal can have a combined coefficient of thermal expansion which essentially matches that of the insulator. In this manner, during thermal cycling the metal and feed-through expand and contract at the same rate to maintain a hermetic seal.

Components produced with this type of electrical feed-through are ideal for electronic packaging applications and other applications where low cost, hermetic, multi-trace conductive passages through a wall are required. The present invention provides for lower cost and higher reliability hermetic feed-through production than other methods currently available.

BRIEF DESCRIPTION OF THE DRAWINGS

In the accompanying drawings, the preferred embodiment of the invention and preferred methods of practicing the invention are illustrated in which.

DESCRIPTION OF THE PREFERRED EMBODIMENT

Figure 1A:
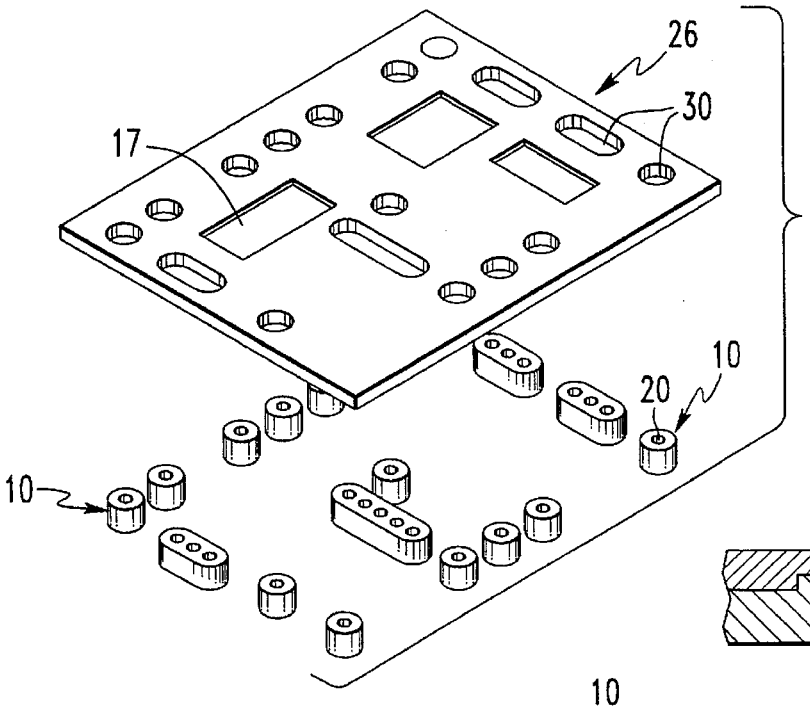
FIGS. 1*a*–1*e* are schematic representations showing a process of the present invention used to produce metal matrix composite components with electrical feed-throughs cast-in place.
Figure 1D:
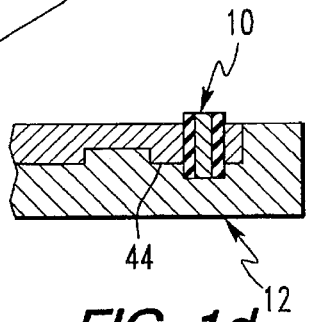
Figure 1B:
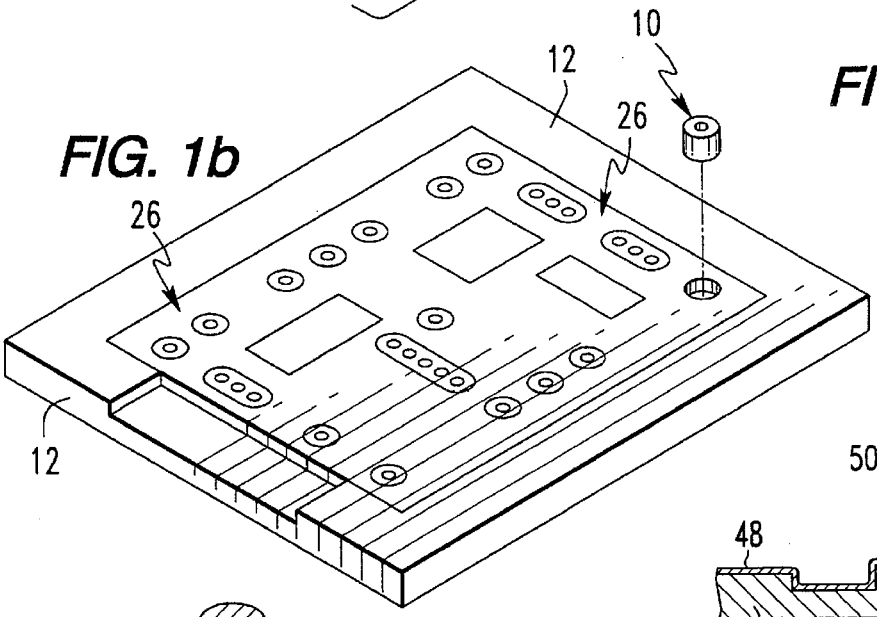
Figure 1E:
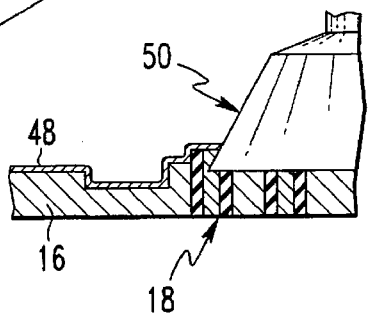
Figure 1C:
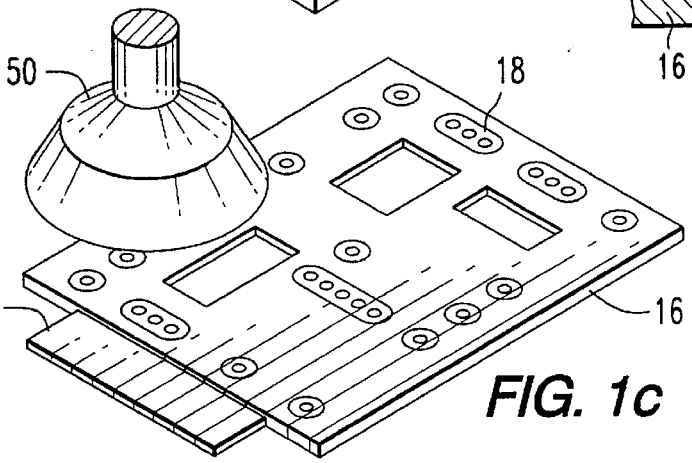

Referring now to the drawings wherein like reference numerals refer to similar or identical parts throughout the several views, and more specifically to FIGS. 1*a*–1*e* thereof, there is shown a method of forming a component 16. The method comprises the step of orienting an insulator 10 in a mold 12. Then, there is the step of introducing molten material 14 into the mold 12 about the insulator 10 to form a component 16 having a cast-in electrical feed-through 18, as shown in FIG. 1*c*. The material 14 can be plastic, metal or a polymer for instance. For purposes of discussion, it will be assumed in the following that the material 14 is a metal. But it should be appreciated that the material 14 is in no manner limited to metals.

Preferably, the insulator 10 has at least one hole 20 and the introducing step includes the step of filling the mold 12 with molten metal 14 to bond the metal 14 to the insulator 10 and to fill the hole 20 with metal. As shown in FIG. 1*c*, after the introducing step, there can be the step of removing any skin of metal between metal within the hole 20 and metal 14 outside of the insulator 10. This can be performed chemically with etching or mechanically with a grinding tool 50.

Figure 2B:
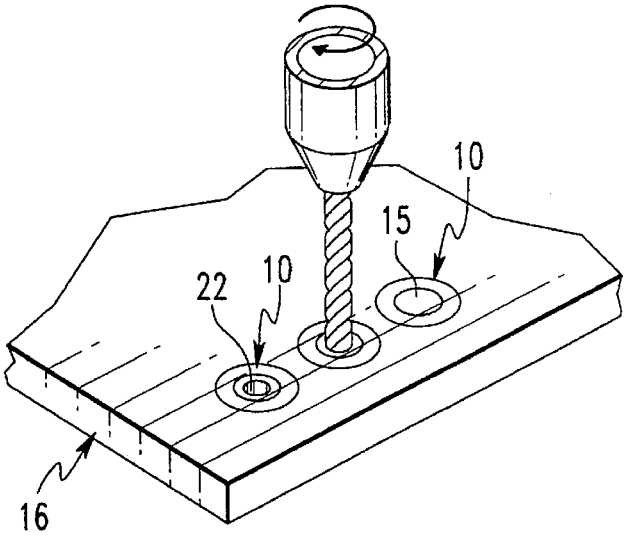
FIGS. 2*a*–2*e* are schematic representations showing conductor pins in cast-in feed-throughs.
Figure 2A:
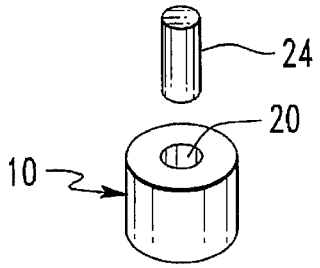
Figure 2C:
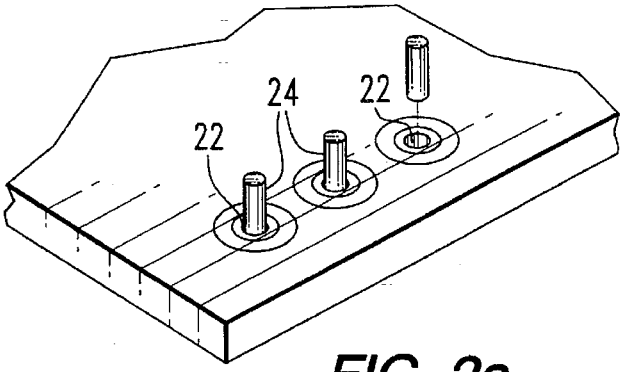
Figure 2D:
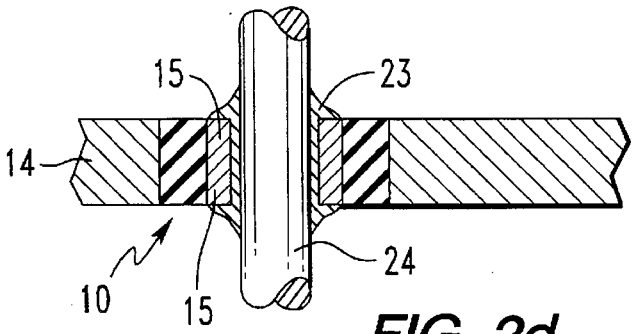
Figure 2E:
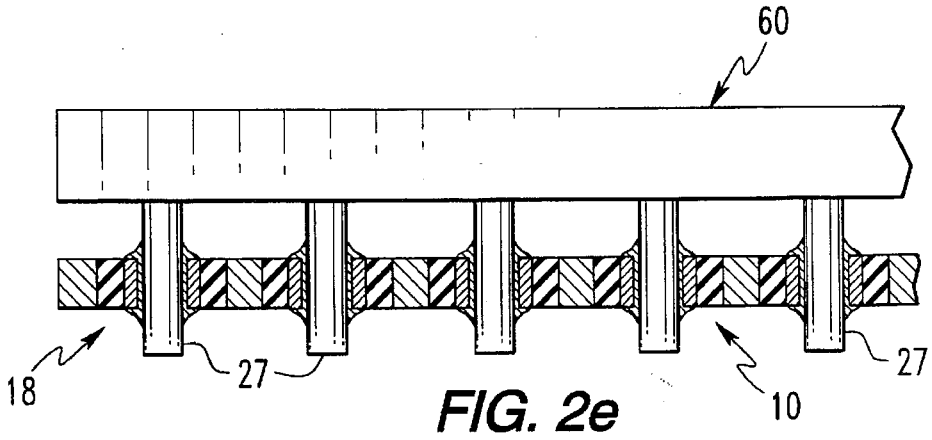

In one embodiment, and as shown in FIGS. 2*b* and 2*c*, after the removing step, there are the steps of drilling a hole 22 into the metal 15 within the insulator 10 and inserting a conductor 24 into the hole 22. The conductor 24 can be brazed, cemented, or soldered with solder 23, as shown in FIG. 2*d*, to the metal 15 within the insulator 10. As shown in FIG. 2*e*, the conductor 24 can be a pin 27 from an electrical device 60.

In another embodiment, as shown in FIG. 2*a*, before the introducing step, there is the step of disposing a conductor 24 within a hole 20 of the insulator 10. Preferably, after the introducing step, there is the step of removing any skin of metal between the conductor 24 and the metal 14 of the component 16.

In yet another embodiment, and as shown in FIGS. 1*a* and 1*b*, before the introducing step, there is the step of placing reinforcement 26, such as a preform, within the mold 12 and the introducing step includes the step of forcing molten metal 14 into the mold 12 to infiltrate the reinforcement 26.

Preferably, as shown in FIG. 1*a*, before the step of placing reinforcement 26 in the mold 12, there is the step of forming holes 30 or pockets 17 in the reinforcement 26 for holding the insulator 10 and the orienting step includes the step of disposing the insulator 10 in the holes 30 of the reinforcement 26.

Insulators may also be cast into the preform prior to loading in the casting mold. In one embodiment, insulators are loaded into a preform injection mold and then a reinforcement suspended in a flow agent are injected into the mold. The resulting part is then debinded to create a preform with insulators which can then be loaded into the casting mold. In another embodiment, single die casting, as described in U.S. Pat. No. 5,183,096, can be used to locate reinforcement around insulators placed in a casting mold.

It should be appreciated that with this invention, almost any material such as plastic or metals may be cast into the mold 12. Plastic or polymers can be used. Aluminum, copper, magnesium, and other metals work well with oxides based on similar systems, for example, aluminum bonds well with aluminum oxide insulators 10 or aluminum nitride insulators 10. Many configurations are possible to produce different types of feed-throughs 18. The present invention can produce feed-throughs 18 into a material for surface mounting of an electronic component 60. It is also possible to create raised pin feed-throughs 18 that may be soldered to or used to plug into spring loaded slip contacts.

Figure 8A:
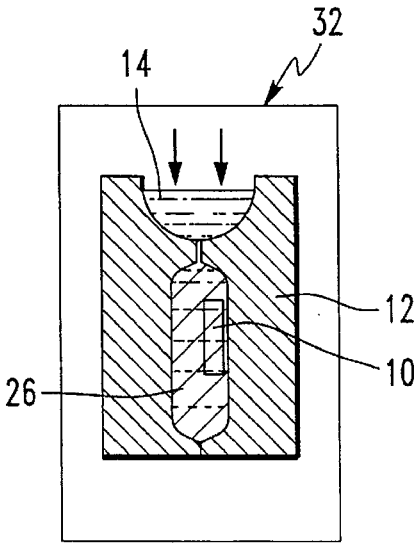
FIGS. 8*a*–8*d* are schematic representations showing various apparatuses for casting components with cast-in feed-throughs.
Figure 8B:
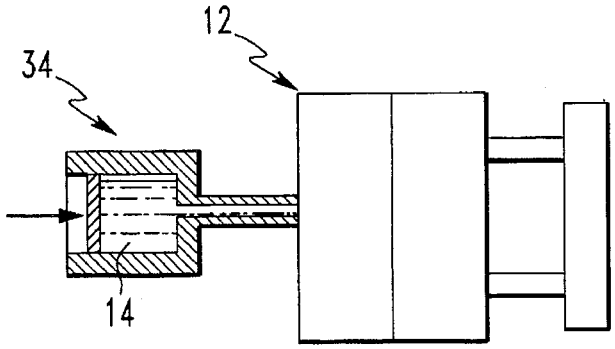
Figure 8C:
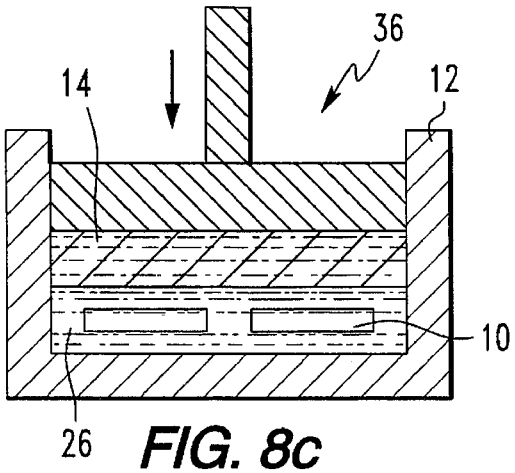
Figure 8D:
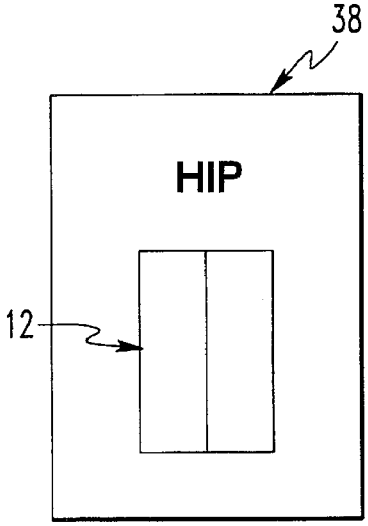

Preferably, the introducing step includes the step of pressurizing liquid material such as a metal into the mold 12 to bond the insulator 10 to the material. In one embodiment, as shown in FIG. 8*a*, before the pressurizing step, there is the step of placing the mold 12 within a pressure vessel 32 and the pressurizing liquid material step includes the step of pressurizing the pressure vessel 32 such that molten material is forced into the mold 12 about the insulator 10, as described in U.S. Pat. No. 5,111,870, incorporated by reference. Alternatively, as shown in FIG. 8*b*, the pressurizing step includes the step of forcing the material 14 into the mold 12 with a die casting machine 34, as described in U.S. Pat. No. 5,183,096, incorporated by reference. Alternatively, as shown in FIG. 8*c*, the pressurizing step includes the step of forcing the material 14 into the mold 12 with a squeeze casting machine 36. Alternatively, as shown in FIG. 8*d*, the pressurizing step includes the step of forcing the material 14 into the mold 12 with a hot isostatic press 38.

Figure 4A:
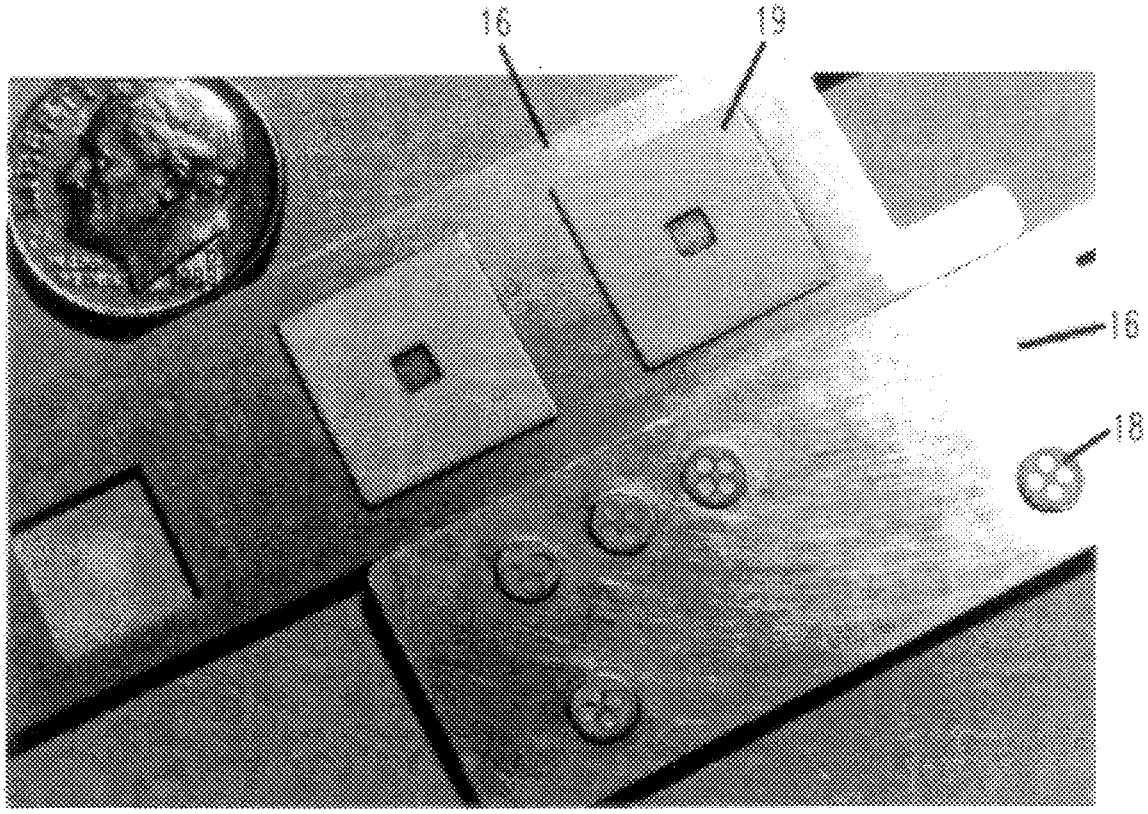
FIGS. 4*a* and 4*b* are photographs of cast-in electrical feed-throughs and substrates.

The present invention also discloses a method of forming a component 16 by inserting a substrate 19 in the mold 12 and introducing molten material 14 into the mold 12 to form a component 16 with a cast-in substrate 19, as shown in FIG. 4*a*.

The substrate 19, by being integrally formed with the material 14 of the component 16, is superior in many applications to a substrate 19 which is attached to the component 16 such as by bonding or welding. A substrate 19 formed with the material 14 in this manner can be hermetically sealed. The substrate 19 and material 14 are one cohesive unit and can even be made to contract and expand at the same rate by matching their thermal coefficients of expansion.

The substrate 19 can be used as an attachment base for an electronic device 60. Also, circuits can be formed on the substrate 19 by layering and masking material thereon as is well known in the art of integrated circuits.

Figure 9:
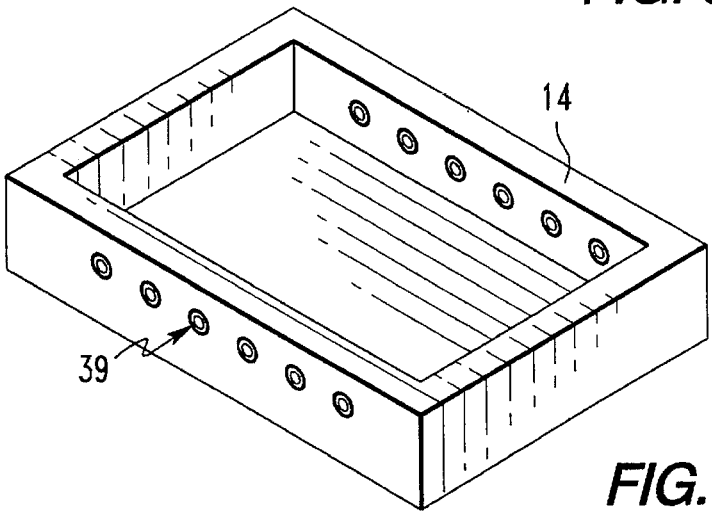
FIG. 9 is a schematic representation showing a plastic component having cast-in conductors.

The present invention also describes a method of forming a component by inserting a conductor in a mold and then introducing molten material around the conductor. The material 14 can be plastic, polymer or metal for example. As shown in FIG. 9, plastic or polymer components 16 having cast-in conductors 39 can be formed for electronic packaging. As described previously, the conductors 39 would be integrally bonded and hermetically sealed with the plastic or polymer 14.

Figure 6A:
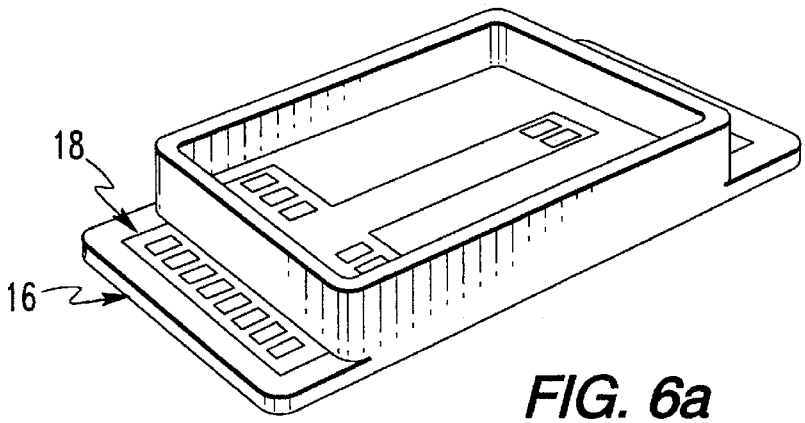
FIGS. 6*a*–6*e* are schematic representations showing cast-in feed-throughs having conductive paths in more than one plane.
Figure 6B:
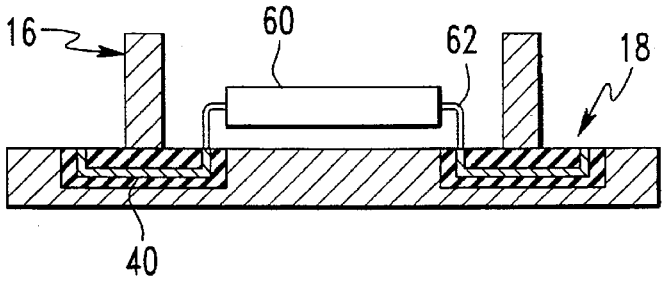
Figure 6C:
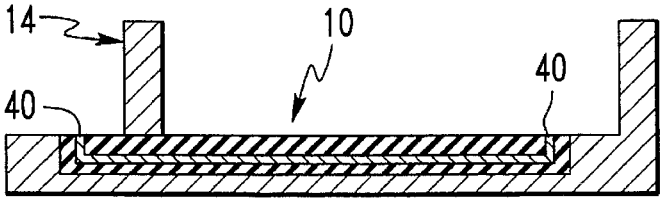
Figure 6D:
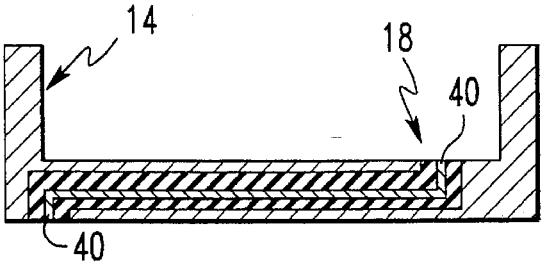
Figure 6E:
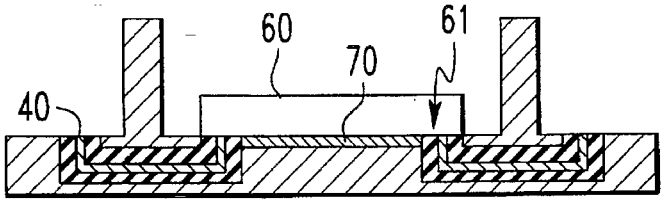

The present invention, as shown in FIG. 6*a*, is also a component 16 comprising metal 14 and an in-situ electrical feed-through 18 disposed in the metal 14. Preferably, the electrical feed-through 18 comprises at least one conductive path 40 disposed through the insulator 10. These conductive paths can be connected to metallic pads 60 on the substrate 19 or can be produced electrically isolated from the metallic pads 60 to form an electronic package with a cast-in electronic circuit. As described previously, the metal 14 and the conductive path 40 can be comprised of the same material or of different materials. Preferably, the component 16 comprises reinforcement material 26 infiltrated by the metal 14. Preferably, the reinforcement 26 and metal 14 have a combined coefficient of thermal expansion which essentially matches that of the insulator 20. In this manner, during thermal cycling the metal 14 and feed-through 18 expand and contract at the same rate to ensure a hermetic seal. The concept of forming metal matrix composites with matching CTE molds is disclosed in U.S. patent application Ser. No. 07/795,105, incorporated by reference.

It should be noted that the concept of matching the thermal conductivity of an insert with the component material is not limited to electrical feed-throughs but is also applicable to substrates, conductors or any other desirable insert.

The reinforcement 26 can be in the shape of a preform, loose powder or in-situ formation such as disclosed in Single Die Casting, U.S. patent application Ser. No. 08/012,058 and U.S. Pat. No. 5,183,096, both incorporated by reference.

In operation, as shown in FIGS. 1*a*–1*c*, multi-hole ceramic insulators 10 are produced by pressing and then sintering aluminum oxide to at least 95% density. A preform 26 of 74% silicon carbide is loaded into a casting mold 12 of an electronic package. Holes 30 are created in the preform 26 in which ceramic insulators 10 are inserted. The preform 26 may also have pockets 17. These insulators 10 may contain conductors 24 of different materials or they may be left empty in which case they will fill with the casting metal 14 to create an electrical feed-through 18. After the insulators 10 and reinforcement 26 are loaded into the mold 12, liquid metal 14 is forced into the mold 12 surrounding the reinforcement 26 and insulators 10, with a pressure casting machine 32, such as that described in U.S. Pat. No. 5,111,870. The pressure is then increased to infiltrate the metal 14 into the reinforcement 26 and to assist in bonding the aluminum 14 to the insulators 10 and any conductors 24 they may contain. It is also preferable to pull a vacuum on the mold 12, reinforcement 26 and insulators 10 and to heat up the mold 12 and its contents prior to infiltration with liquid metal 14.

An A356 alloy at 600° C. may be infiltrated into a silicon carbide reinforcement 26 at pressures less than 2000 psi if the preform 26 and insulators 10 are near the melting point of the aluminum alloy 14. After casting, the component 16 is removed from the mold 12 and the ends of the ceramic insulators 10 are ground off, as shown in FIG. 1*e*, which removes the skin 48 of aluminum to expose the in-situ electrical feed-throughs 18. After the insulators 10 are exposed either by mechanical or chemical means, the conductors 24 may be plated as required, the use of gold or gold alloy conductor pins 24 in the ceramic insulators often removes the need for plating. An electrical component 60 may be soldered onto the electrical feed-throughs 18 or the feed-throughs 18 may be used with other types of contacts such as electrically conductive elastomers or spring clips.

In another preferred embodiment, copper may be used in place of aluminum and the reinforcement is moly or tungsten powder instead of silicon carbide.

Aluminum and copper composites are preferred because they allow for the creation of low coefficient of thermal expansion (CTE) materials which can be made to match the CTE of the insulators 10 used to create the electrical feed-throughs 18. Magnesium as well as nickel alloys may also be used as the casting metal 14 as well as polymer or polymer composites.

In one embodiment, and as shown in FIG. 1*d*, the insulators 10 are made slightly longer and held in place by recesses 44 in the mold 12.

Figure 3A:
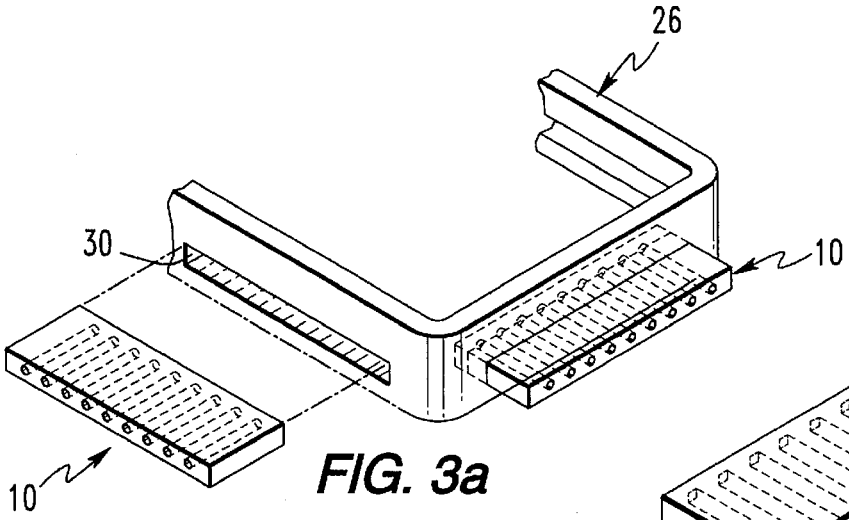
FIGS. 3*a*–3*f* are schematic representations showing the formation of planer electrical feed-throughs in an electronic package.
Figure 3B:
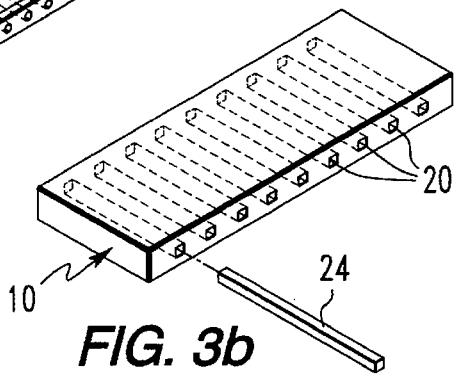
Figure 3C:
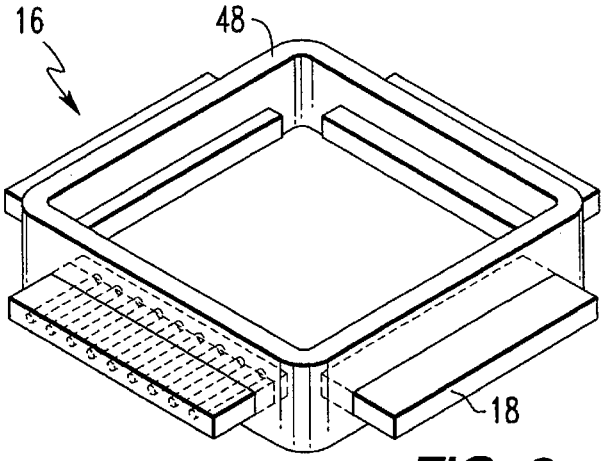
Figure 3D:
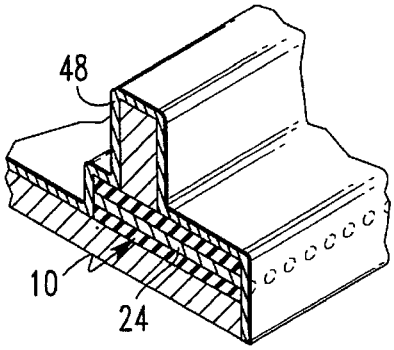
Figure 3F:
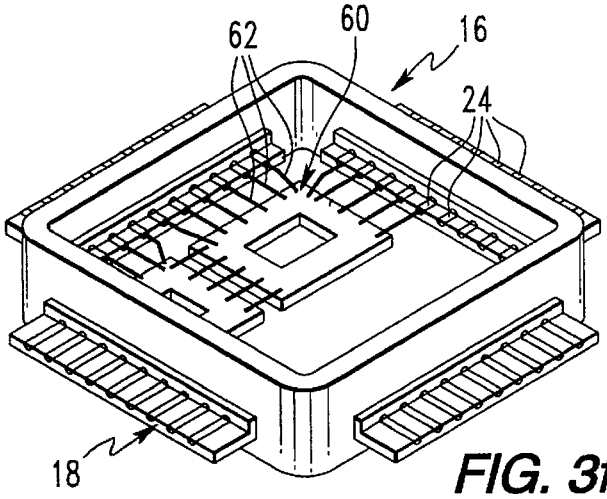
Figure 3E:
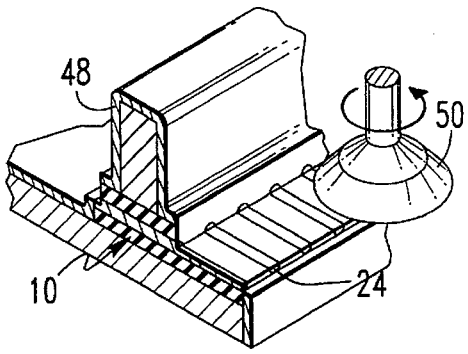

FIGS. 2*a*–2*c* and 3*c* show that metal center of the insulator 10 may be drilled out and conductor pins 24 may be cemented, pressed, or soldered into place in the insulator 10. In FIG. 3*a*, insulators 10 are inserted into a preform 26. FIG. 3*b* shows conductor pins 24 being placed in the holes 20 of the insulator 10. FIG. 3*c* shows the cast component 16 with a uniform metal skin 48 around it. FIG. 3*d* shows a cross-section through the cast component 16 showing the metal skin 48. FIG. 3*d* shows a grinder 50 removing the metal skin 48 to expose the conductor pins 24 inside. It should be noted that by raising the insulator 10 (or substrate or conductor) above the reinforcement 26, the metal skin 48 can be grinded off of the insulator 10 while leaving a metal skin 48 on areas of the mold not having the insulators 10. Alternatively, the insulators 10 can be made flush with the reinforcement 26 and the entire skin 48 can be grinded off on a surface of the component 16. After grinding, the conductor pins 24 can be plated and an electrical device 60 can be attached within the component 16 having wires 62 soldered to the conductor pins 24, as shown in FIG. 3*f*.

Figure 7A:
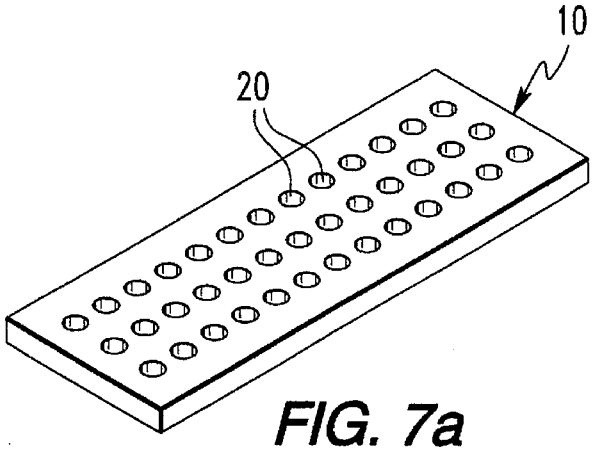
FIGS. 7*a*–7*c* are schematic representations showing a multi-pin cast-in electrical feed-through for a bottom and side wall of an electronic package.
Figure 7B:
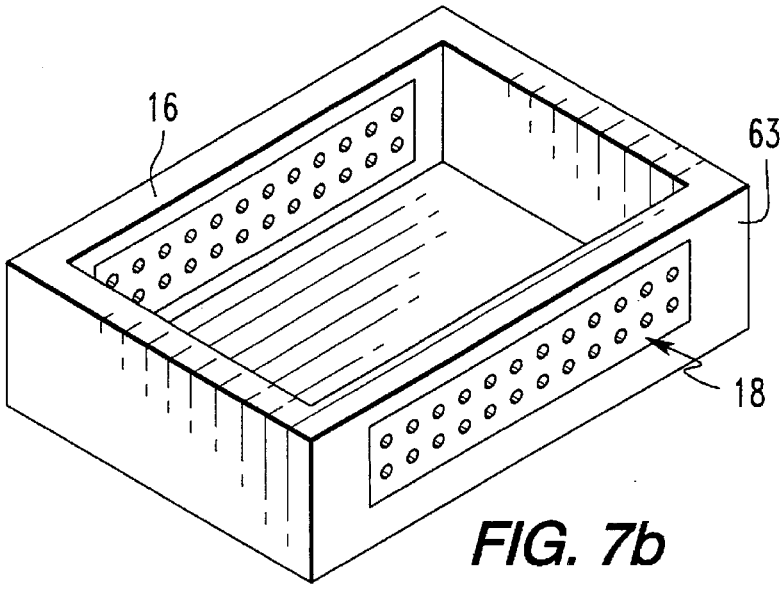
Figure 7C:
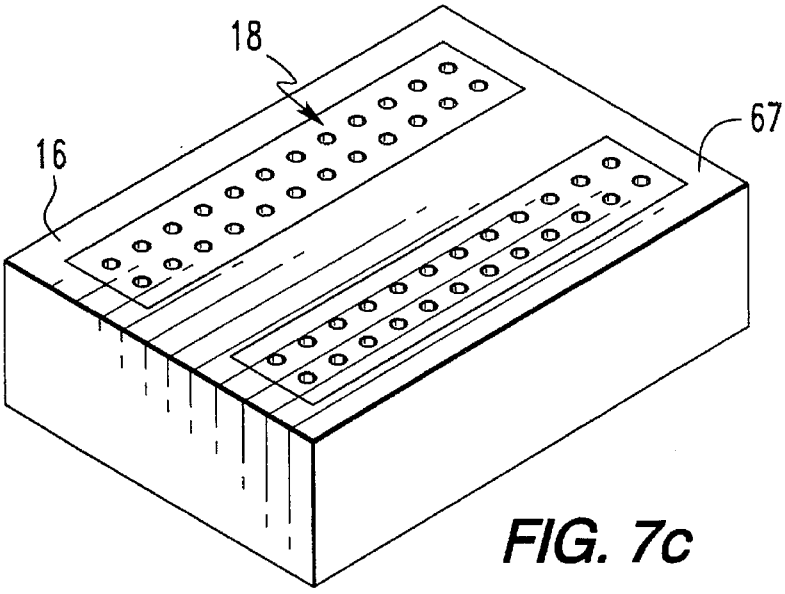

FIGS. 7*a*–7*c* shows planer type feed-throughs 18 created in the sides 63 or bottom 67 of an electronic package 16, such as those required for packaging multi-chip modules.

FIGS. 6*a*–6*e* show various conductive paths 40 through more than one plane of a component 16. Preferably, this type of feed-through system is created by making a 100% ceramic body with a hollow path that exists in the ceramic in more than one plane. This can be done by making a ceramic in two or more pieces and then sintering the two pieces together. In this procedure, it is then possible for a conductive path 40 to be created which moves horizontally and vertically through the component 16. The hollow area may be filled with the infiltrating metal 14 to create the conductor within the feed-through 18 or a conductor 24 may be placed in the hole 20 of the insulator 10 before or after sintering. The conductor 24 may be a solid metal such as a pin or wire, or the conductor 24 may be formed of fused particles such as done with a conductive ink in co-fired ceramics feed-throughs. The conductor 24 can act as a power bus. There can be a thermal connection 70 between the electronic component 60 and the component 16 for effecting efficient heat transfer.

Figure 4B:
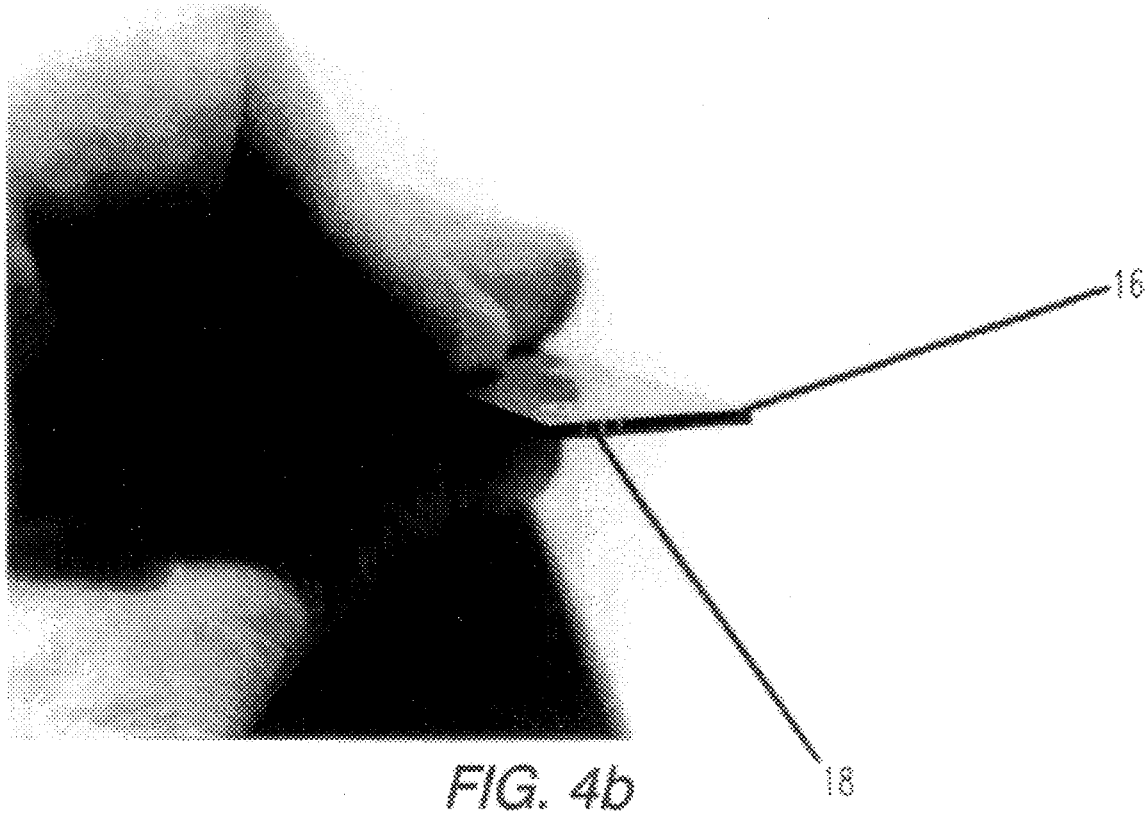
Figure 5A:
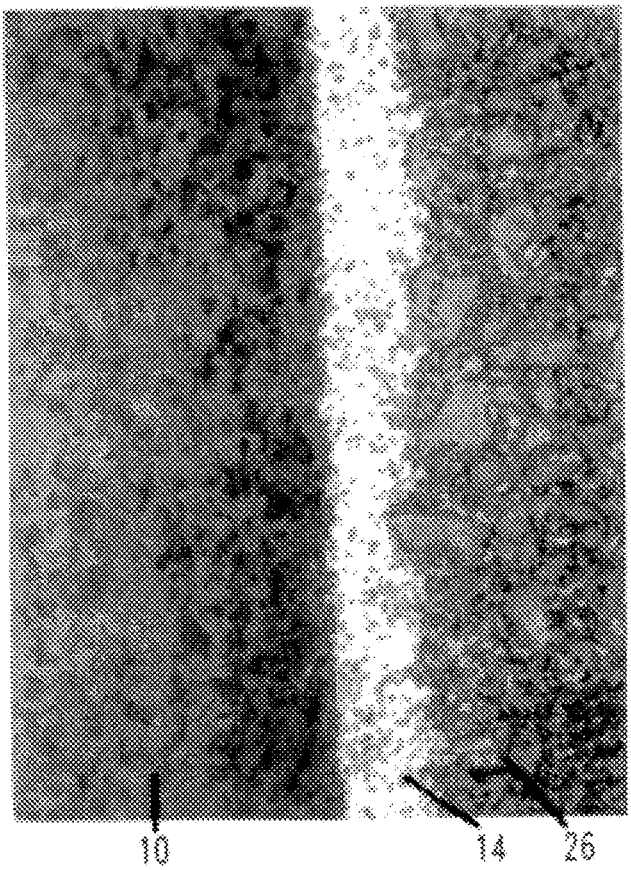
FIGS. 5*a* and 5*b* are photographs showing microstructural cross-sections, at 400X and 1500X, respectively, illustrating the bonding between aluminum and an alumina insulator.
Figure 5B:
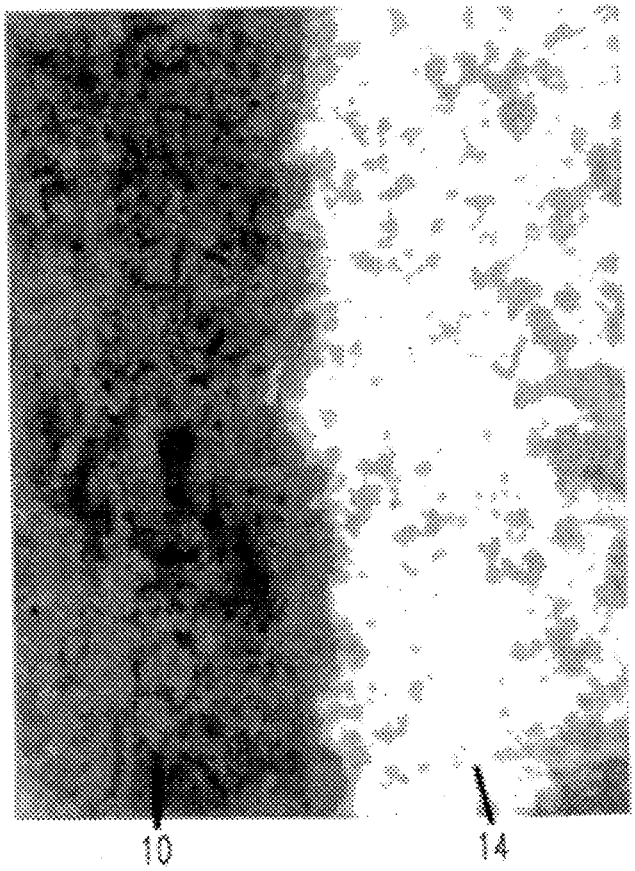

FIG. 4*a* show a top view photograph of components 16 with a cast-in alumina substrates 19 and feed-throughs 18. FIG. 4*b* shows a side view photograph of a component 16 with a cast-in feed-through 18. FIG. 5*a* is a microstructural cross-section at 400X showing the hermetic bonding between the metal 14, in this case alumina, and insulator 10, in this case, ceramic. FIG. 5*b* is the same microstructural cross-section at 1500X.

Although the invention has been described in detail in the foregoing embodiments for the purpose of illustration, it is to be understood that such detail is solely for that purpose and that variations can be made therein by those skilled in the art without departing from the spirit and scope of the invention except as it may be described by the following claims.

What is claimed is:

1. A method of forming a component comprising the steps:

orienting a plurality of insulators in a mold;

disposing reinforcement within the mold; and pressurizing at above atmospheric pressure molten metal into the mold about the insulator to bond the insulator to the metal and to infiltrate the reinforcement to form a composite component having at least one wall and a base and having cast-in electrical feed-throughs that extend through the wall or base of the component in such a way that they connect the inside surface of the wall or base with the outside surface of the wall or base.

2. A method as described in claim 1 wherein the pressurizing step produces a hermetically sealed feed-through.

3. A method as described in claim 2 wherein the insulator has a hole and the pressurizing step includes the step of filling the mold with the molten metal to bond the metal to the insulator and to fill the hole with the metal.

4. A method as described in claim 3 wherein after the pressurizing step, there is the step of removing any skin of metal between metal within the hole and metal outside of the insulator.

5. A method as described in claim 4 wherein the removing step includes the step of chemically etching the skin.

6. A method as described in claim 5 wherein after the removing step, there are the steps of drilling a hole into the metal within the insulator and inserting a conductor into the hole.

7. A method as described in claim 6 wherein after the inserting step, there is the step of brazing the conductor to the metal within the insulator.

8. A method as described in claim 6 wherein after the inserting step, there is the step of cementing the conductor to the metal within the insulator.

9. A method as described in claim 1 wherein before the pressurizing step, there is the step of disposing a conductor within a hole of the insulator.

10. A method as described in claim 9 wherein after the pressurizing step, there is the step of removing any skin of metal between the conductor and the metal of the component.

11. A method as described in claim 10 wherein the removing step includes the step of chemically etching the skin.

12. A method as described in claim 1 wherein before the step of disposing reinforcement in the mold, there is the step of forming holes in the reinforcement for holding the insulator and the orienting step includes the step of disposing the insulator in the holes of the reinforcement.

13. A method as described in claim 1 wherein the disposing step includes the step of forming reinforcement about the insulator in the mold.

14. A method as described in claim 13 wherein the forming step includes the step of forcing reinforcement in a liquid suspension into the mold about the insulator.

15. A method as described in claim 14 wherein the forming step includes the step of positioning the reinforcement about the insulator in the mold with gravity.

16. A method as described in claim 1 wherein the step of orienting an insulator is such that a planar feed-through is created in the component.

17. A method as described in claim 1 wherein the metal is comprised of aluminum.

18. A method as described in claim 1 wherein the insulator is comprised of a ceramic.

19. A method as described in claim 1 wherein the insulator is comprised of alumina.

20. A method as described in claim 1 wherein the insulator is comprised of a polymer.

21. A method as described in claim 1 wherein the insulator is comprised of graphite.

22. A method as described in claim 1 wherein the metal is comprised of a ferrous alloy.

23. A method as described in claim 1 wherein the metal is comprised of a nonferrous alloy.

24. A method as described in claim 1 wherein before the pressurizing step, there is the step of placing the mold within a pressure vessel and the pressurizing liquid material step includes the step of pressurizing the pressure vessel such that molten material is forced into the mold about the insulator.

25. A method as described in claim 1 wherein the pressurizing step includes the step of injection molding the material into the mold.

26. A method as described in claim 1 wherein the pressurizing step includes the step of forcing the material into the mold with a squeeze casting machine.

27. A method as described in claim 1 wherein the pressurizing step includes the step of forcing the material into the mold with a hot isostatic press.

28. A method as described in claim 9 wherein the pressurizing step hermetically seals the conductors to the insulator with liquid metal.

29. A method as described in claim 9 wherein the conductors are comprised of gold or gold alloy which do not require plating.

30. A method as described in claim 9 wherein the conductors are comprised of copper or nickel alloy which do not require plating.

31. A method as described in claim 1 wherein the pressurizing step forms a component having a electrical feedthrough with a conductive path through multi-planes.

32. A method as described in claim 1 wherein the orienting step includes the step of disposing a ceramic substrate in the mold.

33. A method as described in claim 32 wherein the ceramic substrate contains electrically conductive paths.

34. A method as described in claim 33 wherein the ceramic substrate contains electrical circuits and devices.

35. A method as described in claim 1 wherein the step of forcing molten metal into the reinforcement is such that the metal and reinforcement have a coefficient of thermal expansion which essentially matches that of the insulator.

36. A method of forming a component comprising the steps of:

orienting an insulator substrate in a mold;

disposing reinforcement within the mold; and pressurizing at above atmospheric pressure molten metal into the mold about the insulator substrate to bond the insulator substrate to the metal and to infiltrate the reinforcement to form a hermetic component having a cast-in insulator substrate and a base with at least a first wall extending from the base and a conductor path electrically isolated from the wall and base of the component.

37. A method as described in claim 36 wherein after the pressurizing step, there is the step of removing any skin about the substrate.

38. A method as described in claim 37 wherein after the removing step, there is the step of attaching an electrical device to the substrate.

39. A method as described in claim 37 wherein after the removing step, there is the step of layering materials on the substrate to form an electrical circuit.

40. A method of forming a component comprising the steps of:

orienting a plurality of conductors in a mold;

disposing reinforcement within the mold; and pressurizing at above atmospheric pressure molten metal into the mold about the conductors and to infiltrate the reinforcement to form a hermetic component having at least one wall and a base and cast-in conductors which extend through the wall or base of the component in such a way that they connect the inside surface of the wall or base with the outside surface of the wall or base.

41. A method as described in claim 40 wherein the orienting step includes the step of disposing a conductor within an insulator in the mold.

* * * * *